US011730249B2

(12) United States Patent
Eng

(10) Patent No.: US 11,730,249 B2
(45) Date of Patent: Aug. 22, 2023

(54) COSMETIC JARS WITH SWEEP COLLAR

(71) Applicant: HCT GROUP HOLDINGS LIMITED, Sheung Wan (CN)

(72) Inventor: Nolan Quentin Eng, Foothill Ranch, CA (US)

(73) Assignee: HCT GROUP HOLDINGS LIMITED, Sheung Wan (HK)

( * ) Notice: Subject to any disclaimer, the term of this patent is extended or adjusted under 35 U.S.C. 154(b) by 565 days.

(21) Appl. No.: 16/297,132

(22) Filed: Mar. 8, 2019

(65) Prior Publication Data

US 2019/0281949 A1 Sep. 19, 2019

Related U.S. Application Data

(60) Provisional application No. 62/643,406, filed on Mar. 15, 2018.

(51) Int. Cl.

| | |
|---|---|
| ***A45D 33/00*** | (2006.01) |
| ***B65D 53/02*** | (2006.01) |
| ***B65D 41/04*** | (2006.01) |

(52) U.S. Cl.

CPC ..... *A45D 33/003* (2013.01); *B65D 41/04* (2013.01); *B65D 53/02* (2013.01); *A45D 2200/051* (2013.01); *A45D 2200/25* (2013.01)

(58) Field of Classification Search

CPC ..... B65D 55/066; B65D 65/18; B65D 47/40; B65D 23/06; B65D 23/065; A46B 11/0079; A46B 11/0093; A46B 11/0096; A45D 34/00; A45D 2034/002; A45D 2034/04; A45D 2034/042; A45D 2034/045; A45D 2034/046; A45D 2034/047; A45D 33/00; A45D 33/003; A45D 33/02; A45D 33/025; A45D 33/16; A45D 33/24; A45D 33/34; A45D 40/00; A45D 2040/0006; A45D 40/0068; A45D 40/0075; A45D 40/20; A45D 2040/208; A45D 2200/00;

(Continued)

(56) References Cited

U.S. PATENT DOCUMENTS

| | | | |
|---|---|---|---|
| 1,156,456 | A | 10/1915 | Beck |
| 1,357,306 | A | 11/1920 | Aste |

(Continued)

FOREIGN PATENT DOCUMENTS

| | | | |
|---|---|---|---|
| CN | 2722696 | Y | 9/2005 |
| EP | 2543275 | A1 | 1/2013 |

(Continued)

OTHER PUBLICATIONS

JP5366202B2 Machine Translation (Year: 2013).*

(Continued)

*Primary Examiner* — Cris L. Rodriguez
*Assistant Examiner* — Karim Asqiriba
(74) *Attorney, Agent, or Firm* — Seager, Tufte & Wickhem LLP

(57) ABSTRACT

A cosmetic jar container configured with a collar insert to help distribute loose powder product on an applicator. An illustrative cosmetic jar includes a cap, ajar having a reservoir and a neck, and a collar secured to the neck of the jar. The collar includes a manipulation surface inside the neck for use in distributing a powder product on an applicator and/or removing excess product from the applicator.

15 Claims, 12 Drawing Sheets

(58) Field of Classification Search
CPC ..... A45D 2200/05; A45D 2200/051; A45D 2200/053; A45D 2200/1036; A45D 2200/25
USPC ..... 206/581; 220/200, 377, 602, 694, 695, 220/698, 699, 700; 132/293, 302; D9/503, 504; D28/76–91
See application file for complete search history.

(56) References Cited

U.S. PATENT DOCUMENTS

| | | | | |
|---|---|---|---|---|
| D94,984 | S | 3/1935 | Noble | |
| 2,817,451 | A | 12/1957 | Giles et al. | |
| D203,137 | S | 12/1965 | Braun | |
| D303,584 | S | 9/1989 | Bakic | |
| 5,598,929 | A | 2/1997 | Jensen et al. | |
| 6,053,183 | A * | 4/2000 | Rizzo | A45D 33/006 132/307 |
| D432,224 | S | 10/2000 | Hautmann et al. | |
| 6,138,687 | A | 10/2000 | Sheffler et al. | |
| D442,338 | S | 5/2001 | Roman | |
| 7,028,843 | B2 | 4/2006 | Byun | |
| 7,337,787 | B2 | 3/2008 | Matsuoka | |
| D581,279 | S | 11/2008 | Oates | |
| D582,772 | S | 12/2008 | Bakic | |
| D592,956 | S | 5/2009 | Thiellier | |
| D610,009 | S | 2/2010 | Prufer | |
| D615,867 | S | 5/2010 | Sagaseki | |
| D619,896 | S | 7/2010 | Iwazu | |
| 7,909,195 | B2 | 3/2011 | Rathbone | |
| 7,959,369 | B2 | 6/2011 | Gueret | |
| D651,519 | S | 1/2012 | Gibson | |
| 8,132,578 | B2 * | 3/2012 | LoPrete | A45D 33/025 132/307 |
| D661,989 | S | 6/2012 | Praster | |
| 8,210,187 | B1 | 7/2012 | Zhang | |
| D691,888 | S | 10/2013 | Mettler | |
| 10,582,754 | B2 * | 3/2020 | Delia | A45D 40/00 |
| 2002/0056660 | A1 | 5/2002 | Gueret | |
| 2003/0154997 | A1 | 8/2003 | Lin | |
| 2005/0011895 | A1 | 1/2005 | Lin | |
| 2006/0186019 | A1 * | 8/2006 | Lu | A45D 33/003 206/581 |
| 2006/0226156 | A1 | 10/2006 | Lundy et al. | |
| 2009/0205673 | A1 | 8/2009 | Richardson | |
| 2010/0012145 | A1 | 1/2010 | LoPrete | |
| 2013/0319454 | A1 * | 12/2013 | Kim | A45D 33/006 132/298 |
| 2015/0114965 | A1 * | 4/2015 | Tobey | B65D 47/043 220/256.1 |
| 2016/0058069 | A1 | 3/2016 | Rushforth | |
| 2016/0083152 | A1 | 3/2016 | Eberlein | |
| 2018/0016055 | A1 * | 1/2018 | Tobey | B65D 51/18 |
| 2018/0049534 | A1 * | 2/2018 | Kim | A45D 33/24 |
| 2018/0110315 | A1 * | 4/2018 | McGraw | A45D 40/00 |
| 2019/0037999 | A1 * | 2/2019 | Mecca | A45D 33/02 |

FOREIGN PATENT DOCUMENTS

| | | | | |
|---|---|---|---|---|
| JP | 5366202 | B2 * | 12/2013 | A45D 34/00 |
| KR | 100602426 | B1 | 7/2006 | |
| KR | 20090104593 | A | 10/2009 | |
| WO | 2006101339 | A1 | 9/2006 | |
| WO | 2014116027 | A2 | 7/2014 | |

OTHER PUBLICATIONS

Lekeux, "My Cosmetics Range" LeKeux HQ, retrieved on Feb. 24, 2015 at http://lekeuxhq.blogspot.eom/2014/11/my-cosmetics-range.html, 6 Pages.

International Search Report and Written Opinion dated Jun. 26, 2019 for International Application No. PCT/US2019/021394.

* cited by examiner

COSMETIC JARS WITH SWEEP COLLAR

RELATED APPLICATIONS

This application claims the benefit of and priority to U.S. Provisional Patent Application No. 62/643,406, filed on Mar. 15, 2018, titled COSMETIC JARS WITH SWEEP COLLAR, the disclosure of which is incorporated herein by reference.

FIELD

The present application relates generally to jar and lid assemblies for containing cosmetics.

BACKGROUND

The cosmetic industry generally uses cosmetic jar containers to store cosmetic compositions which may include various powders, liquids or creams. Ajar typically includes body that forms a reservoir for containing product with a neck at the upper end thereof. The exterior of the neck may include threading or a snap fit structure for coupling to a lid.

Loose powder is typically harder to work with as compared to pressed powder as it can be messy. A typical user will insert a brush or other applicator in the reservoir of loose powder in ajar and rub the applicator or bush against the inside of the neck while removing it from the reservoir to remove excess product before applying to body. The result is typically that the product is unevenly distributed on the applicator.

The jar and/or lid of the cosmetic jar container are typically made of an opaque material, a glass, a plastic, a metal, combinations of the foregoing, or the like, that when closed together create an airtight seal. These jar and lid assemblies may be sealed by a thread fastening mechanism, a snap fastening mechanism, or a clamp fastening mechanism. For additional air-tight sealing, an O-ring or a gasket may be interposed by the jar and the lid.

Thus, although portable vessels and applicators exist, there is a continuing need for one to effectively clean the brush of excess product.

OVERVIEW

The present inventors have recognized, among other things, that a problem to be solved is the need for improved cosmetic packaging. In particular, a cosmetics jar is provided with a collar that sits on top of the neck, having a portion extending into the neck to provide a manipulation surface against which a user can rub or scrape an applicator to obtain a desired distribution of product.

A first illustrative, non-limiting example takes the form of a container for storing a cosmetic product comprising: a cosmetic jar having a main body defining a reservoir for containing the product and a neck on an upper portion thereof with an upper end having an opening for accessing product in the reservoir; a collar fitted to the upper end of the neck, the collar having an upper rim defining an opening therethrough and manipulation surface extending down into the reservoir from the upper rim along a portion of the opening; and a cap configured to couple with the main body.

A second illustrative, non-limiting example takes the form of a cosmetic container comprising: a jar having a body defining a reservoir and having a neck allowing access to product in the reservoir; a cap configured for coupling to the jar; and a collar on the neck of the jar having an upper rim and a manipulation surface extending down from the upper rim defining a curved inner edge at a bottom edge thereof such that on one portion of the collar, an inner sidewall extends straight down from the rim and on a second portion of the collar, the manipulation surface extends downward at an angle towards the reservoir, such that the manipulation surface allows a user to scrape, rub or tap a brush thereon.

Additionally or alternatively to any of the above examples, the rim of the collar may comprise an inner side wall that extends into the jar, wherein the manipulation surface of the collar projects inward from the side wall.

Additionally or alternatively to any of the above examples, the cap may be a screw cap assembly comprising an inner lid having at least one horizontal protrusion and at least one vertical recess on its outer surface and an outer shell having at least one horizontal recess and at least one vertical protrusion on its inner surface, and the cap may be assembled such that the horizontal protrusion and horizontal recess cooperate, and the vertical protrusion and vertical recess cooperate, to secure the inner lid and the outer shell together.

Additionally or alternatively to any of the above examples, the inner part of the screw cap assembly may comprise internal threading to mate with external threading of the jar neck.

Additionally or alternatively to any of the above examples, the cap may include a transparent or semi-transparent window on a top surface thereof to view the loose powder product in the reservoir.

Additionally or alternatively to any of the above examples, the collar rim extends around 360 degrees of the neck, wherein the manipulation surface may extend around about 90 to about 270 degrees of the collar rim.

Additionally or alternatively to any of the above examples, the collar rim extends around 360 degrees of the neck, wherein the manipulation surface may extend around about 180 degrees of the collar rim.

Additionally or alternatively to any of the above examples, the neck defines an opening having a diameter, wherein the manipulation surface may extend inward from the neck over about 10% to about 25% of the diameter of the neck.

Additionally or alternatively to any of the above examples, the neck defines an opening having a diameter, wherein the manipulation surface may extend inward from the neck over about 15% of the diameter of the neck.

Additionally or alternatively to any of the above examples, the neck defines an opening having a radius, wherein the manipulation surface may extend inward from the neck over about 15% to about 50% of the radius.

Additionally or alternatively to any of the above examples, the neck defines an opening having a radius, wherein the manipulation surface may extend inward from the neck over about 30% of the radius.

Additionally or alternatively to any of the above examples, the manipulation surface may be generally concave.

Additionally or alternatively to any of the above examples, the manipulation surface may be a flat surface from the top of the rim to its lower edge.

Additionally or alternatively to any of the above examples, the manipulation surface may define an angle, relative to a plane on which the top of the neck is defined, of about 30 to about 65 degrees.

Additionally or alternatively to any of the above examples, the manipulation surface may define an angle, relative to a plane on which the top of the neck is defined, of about 50 degrees.

Additionally or alternatively to any of the above examples, the inner shape of the collar may be circular on one side and oval on the other, the oval side corresponding to the manipulation surface.

A third illustrative and non-limiting example takes the form of method of cleaning excess loose powder from an applicator, the method using a cosmetic container is as in any of the first and second illustrative and non-limiting examples (and additions or alternatives thereto), the cosmetic container having a loose powder product therein, the method comprising: removing the cap from jar; placing the applicator in the loose powder product to receive at least some of the loose powder product; removing excess loose powder product and/or distributing the loose powder product on the brush using the manipulation surface until desired amount and/or distribution of the loose powder product is obtained; and applying the loose powder product on a body part. In such a method, the applicator may be a cosmetic makeup brush, a doefoot application, or any other suitable applicator adapted for use with the loose powder.

This overview is intended to provide an introduction to the subject matter of the present patent application. It is not intended to provide an exclusive or exhaustive explanation of the invention. The detailed description is included to provide further information about the present patent application.

BRIEF DESCRIPTION OF DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
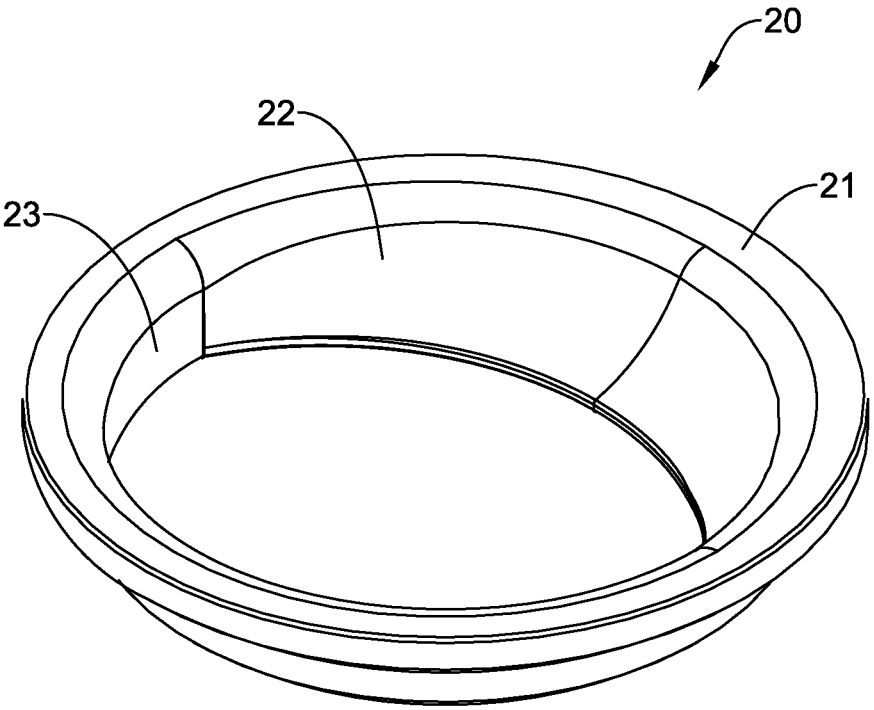
FIG. 1 is a perspective view of an illustrative collar insert.

The following description should be read with reference to the drawings wherein the like reference numerals indicated like elements throughout several views. The description and drawings show several embodiments which are meant to be illustrative in nature.

The present invention provides a cosmetic jar and a method which utilizes an applicator within the cosmetic jar for controlling the desired amount of cosmetics to be used on an application surface. The application surface, as used herein, includes one's skin, hair, nails, etc. and other suitable body parts. For example, the applicator may be used to apply cosmetics to one's face, including the eyes, cheeks, mouth, etc. For purposes of providing a manipulation surface on which the applicator may be manipulated after obtaining a quantity of product form within the far, a collar is provided.

Figure 1A:
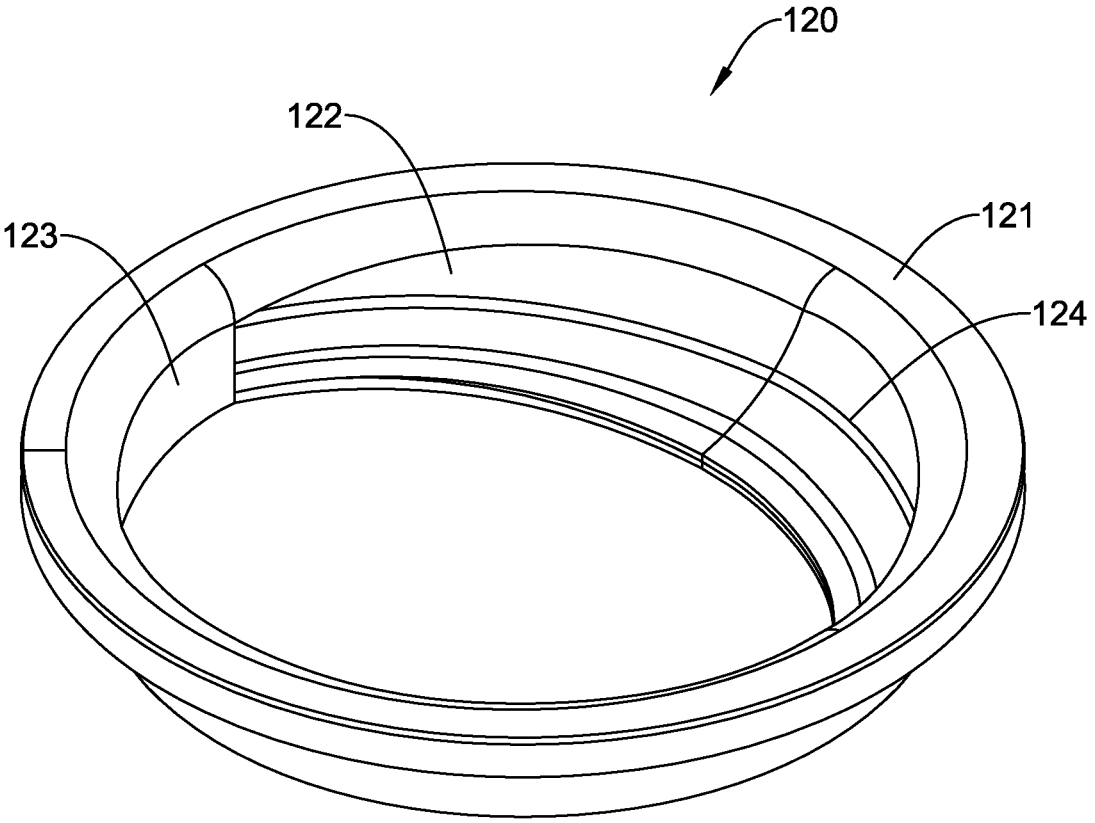
FIG. 1A is a perspective view of another illustrative collar insert.

FIG. 1 is a perspective view of the collar 20. The collar 20 as shown is generally circular in shape and includes a manipulation surface 22. The collar 20 has an upper rim 21 which defines an opening thereof. The manipulation surface 22 may be used to sweep clean the excess loose powder from an applicator, such as that shown in FIG. 8, below. In the example, the manipulation surface 22 extends down toward a reservoir in a jar (shown below) from the upper rim 21. The manipulation surface 22 is preferably a flat surface but may include ridges, bumps, and/or a textured surface or region. FIG. 1A shows a collar 120 with upper rim 121, inner side wall 123, and manipulation surface 122 with ridges 124. A user can, after inserting an applicator or brush into a jar, use the manipulation surface to scrape, rub, tap or otherwise manipulate a brush to remove excess product which is then captured in the jar, avoiding the waste and mess of doing such steps on a separate surface. A user may, in addition or instead of removing excess product, use the manipulation surface to distribute the powder product on the applicator.

Figure 3A:
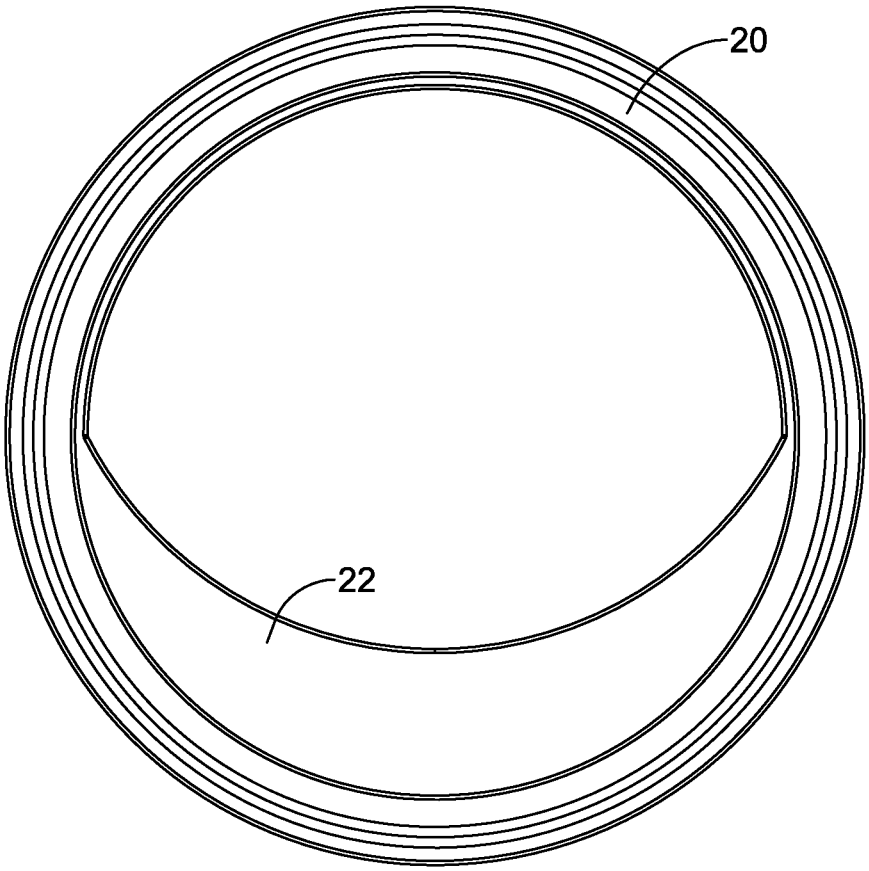
FIG. 3A is an illustrative view of the collar and manipulation surface from the bottom to top view perspective.
Figure 3B:
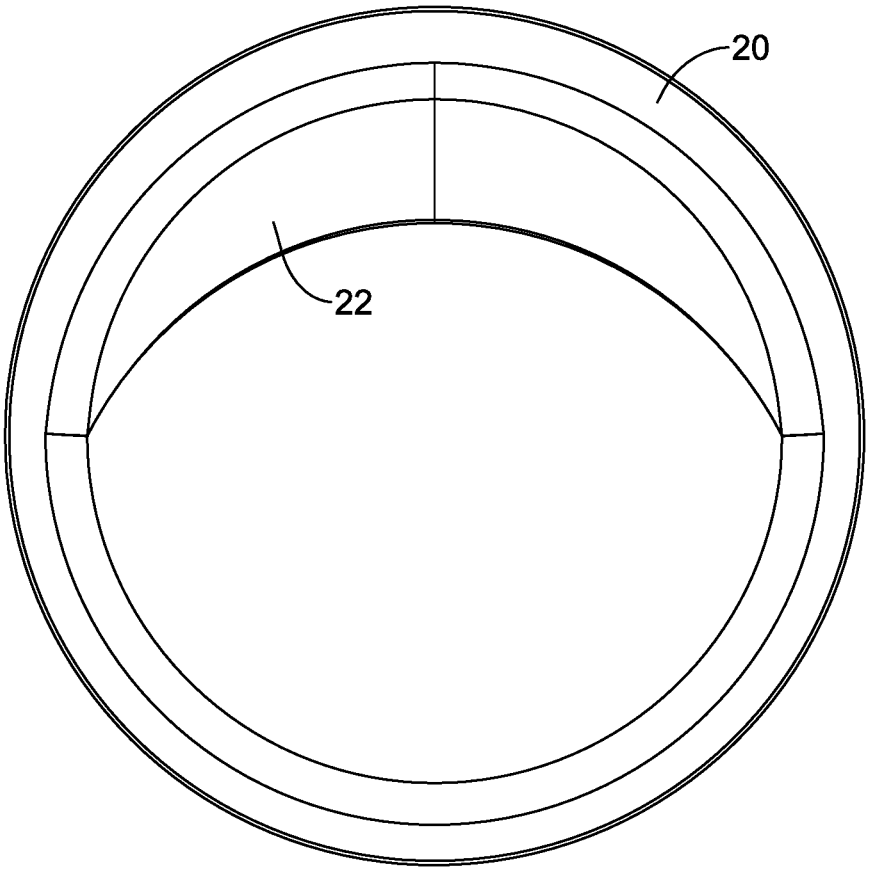
FIG. 3B is an illustrative view of the collar insert from the top to bottom view perspective.

The collar 20 includes an inner side wall 23 that extends about an extent of the circumference thereof. As can be appreciated, the manipulation surface extends out away from the inner side wall 23. In general, the collar 20 may be formed as a single piece by molding, though other processes may be used, and multiple pieces may be assembled, if desired. The inner shape of the collar 20 may be circular on one side and oval on the other, as illustrated in FIGS. 3A-3B, below, wherein the manipulation surface 22 is on the oval side.

On one portion of the collar 20, the inner side wall 23 extends straight down from the upper rim 21 and on a second portion of the collar, the manipulation surface 22 extends downward at an angle toward the reservoir. While the collar rim extends around 360 degrees, the manipulation surface extends about only a portion of the circumference of the collar 20. For example, the manipulation surface 22 may extend around about 90 to 270 degrees of the collar upper rim 21 in some examples. In one embodiment, the collar extends around about 180 degrees of the collar upper rim 21, with the remainder taken up by the inner side wall 23.

The collar 20 may be permanently affixed to the neck 16 of the cosmetic jar, such as by the use of adhesive. Alternatively, the collar 20 may be removable for example, to better facilitate refill of the loose powder product.

Figure 2A:
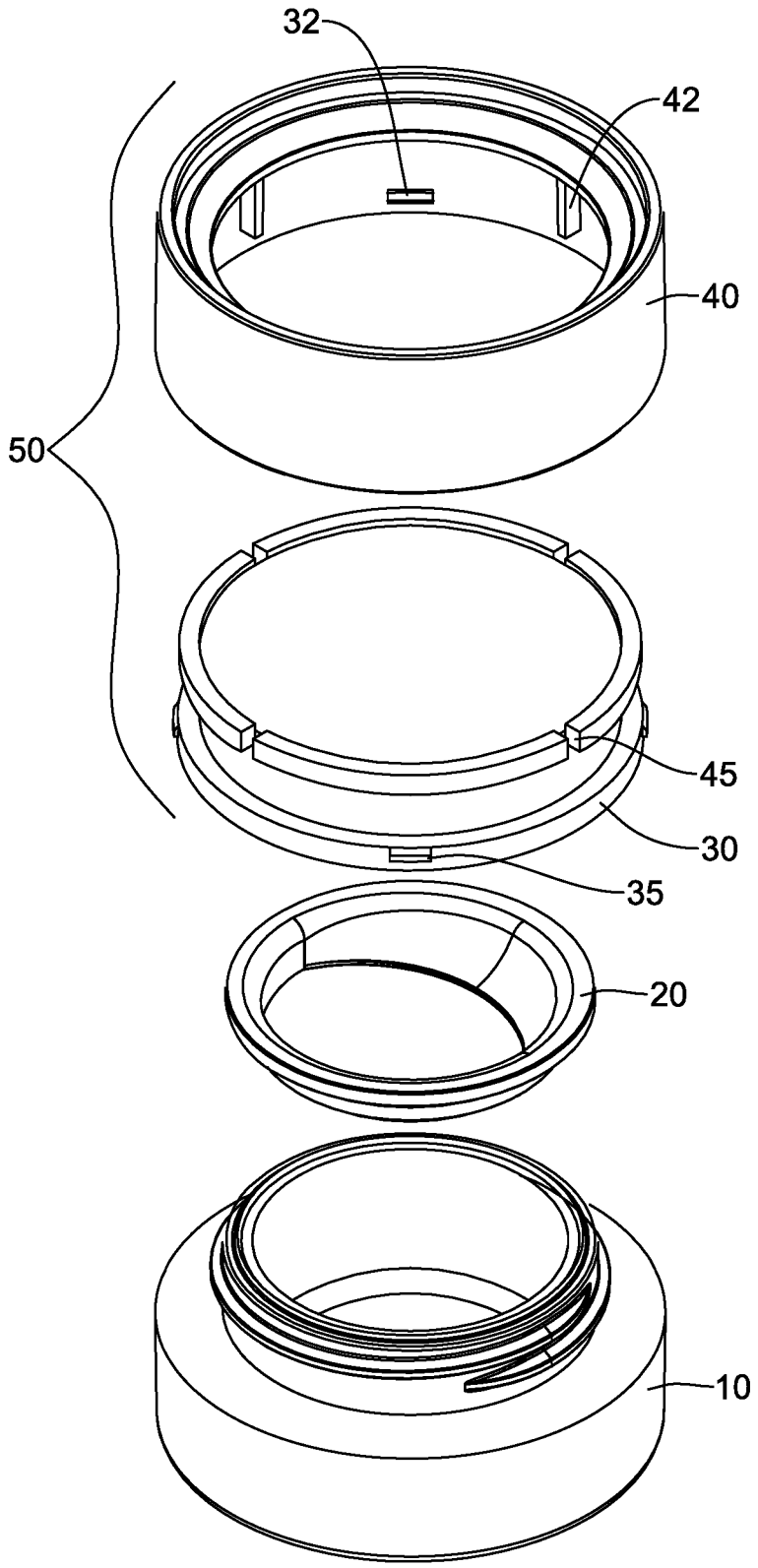
FIG. 2A is an exploded top view of an illustrative cosmetic jar container including a collar with a manipulation surface.
Figure 2B:
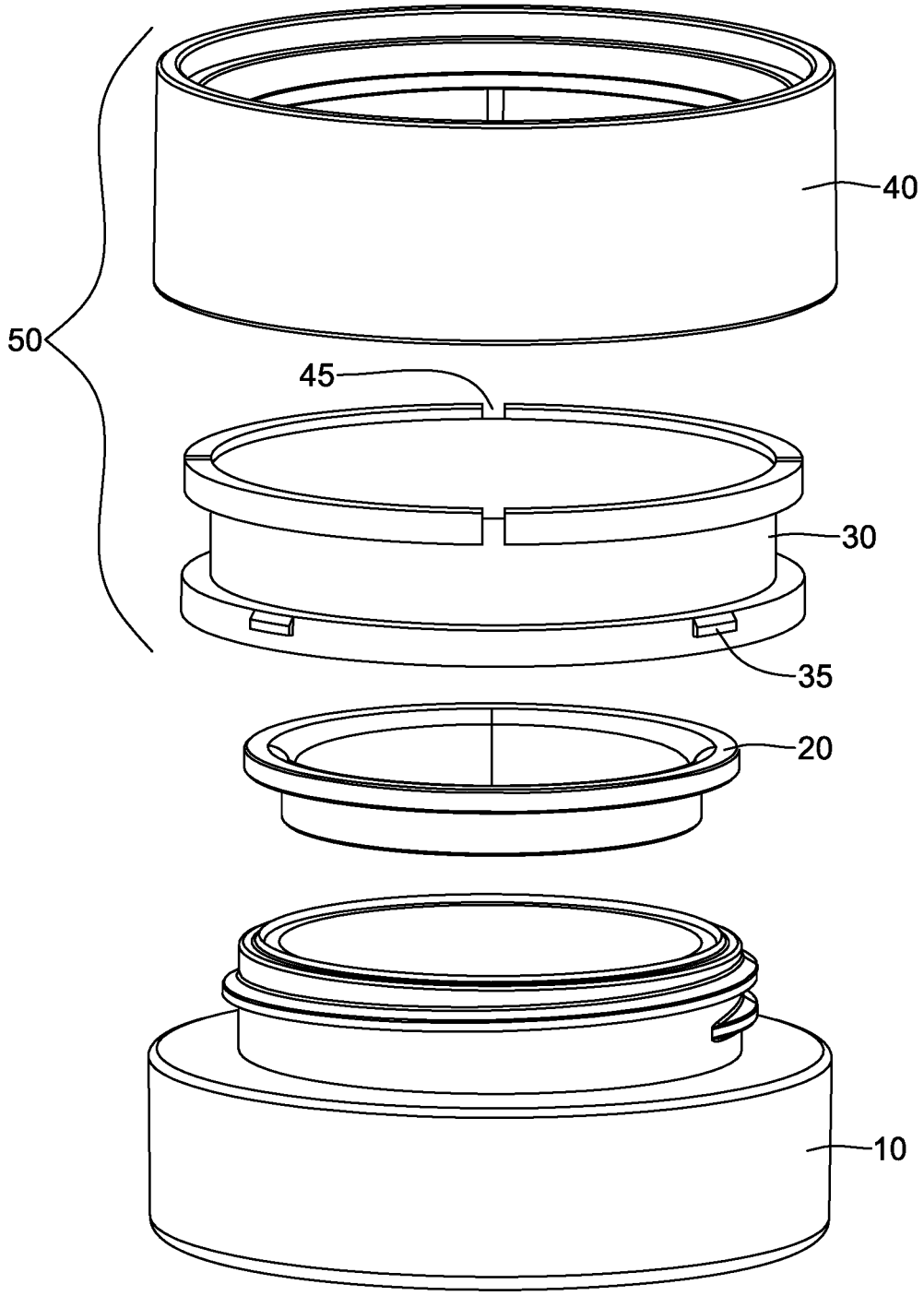
FIG. 2B is another exploded view of a cosmetic jar container.

FIG. 2A is an exploded view from a top perspective of an illustrative cosmetic jar container 10 including a collar 20 with a manipulation surface 22. FIG. 2B is another exploded view of the cosmetic jar container 10, from a lower perspective. The cosmetic jar 10 includes a main body 15 and a neck 16. The container also includes a screw cap 50 which is shown in FIGS. 2A-2B as a two part cap structure or assembly including an outer shell 40 and an inner lid 30.

The neck 16 includes external threading 11 for mating with internal threading 13 (shown in FIG. 5, below) of the inner lid 30. The outer shell 40 comprises a horizontal recess 32 and vertical protrusions 42 for mating with the horizontal protrusion 35 of the inner lid 30 and vertical recess 45 of the outer shell 40, respectively. The horizontal protrusions/recesses and vertical protrusions/recesses are configured to secure the outer shell 40 and inner lid 30 together.

FIGS. 3A and 3B are illustrative views of the collar 20 and manipulation surface 22 from below (FIG. 3A) and above (FIG. 3B). As shown, the collar 20 may be of a circular shape. The manipulation surface 22 may be of a symmetrical crescent or concave shape to extend less than half way of the diameter of the collar 20. In an alternative example, the manipulation surface 22 may be flat/straight, rather than concave. In addition, the manipulation surface 22 may be constructed to extend radially downward towards the cosmetic product within a reservoir 18. The manipulation surface 22 may be smooth in some example. In other examples, one or more of bumps, texture, ridges 124 or other surface features may be provided if desired. See FIG. 1A.

Figure 4:
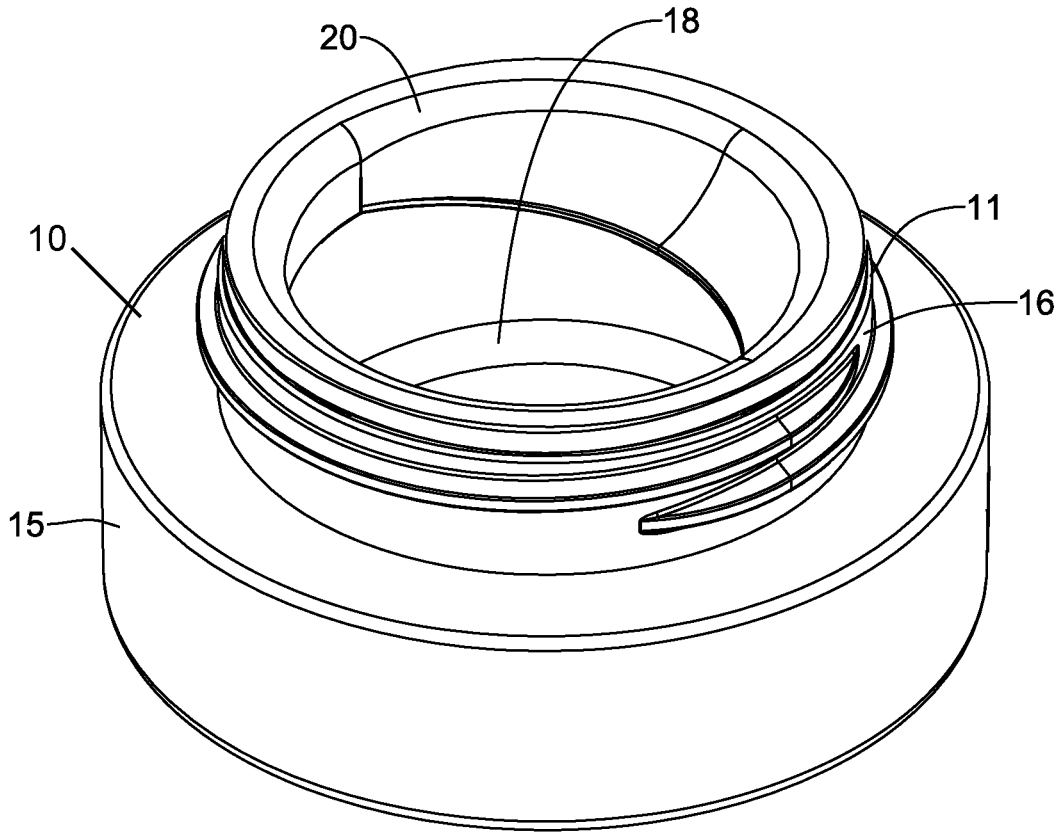
FIG. 4 is an illustrative view of the collar and manipulation surface including the cosmetic jar.

FIG. 4 is an illustrative view of the collar 20 and manipulation surface 22 as placed on a cosmetic jar 10. The cosmetic jar 10 is shown as being circular, however, in other examples, the jar may have an oval, conical, or spherical shape, or may have a polygonal or irregular shape. The neck 16 includes external threading 11 to secure to a cap; in alternative examples, a snap fit structure may be used, or any other suitable coupling.

As shown, the collar 20 is placed on the neck 16. A loose powder or other cosmetic product may be stored within a reservoir 18 or cavity defined at least in part by the neck 16 which is located on the upper portion of the main body 15. The neck 16 has an opening with a diameter. In some illustrative examples, the manipulation surface 22 extends inward from the neck 16 over about 10% to about 25% of the diameter of the neck 16. In an embodiment, the manipulation surface extends inward about 15% of the diameter of the neck 16.

In some examples, the manipulation surface 22 extends inward from the neck 16 about 15% to about 50% of the radius of the neck. In an embodiment, the manipulation surface extends inward to about 30% of the radius of the neck.

If desired, for additional air-tight sealing a gasket or O-Ring may be provided on the collar 20 or integrated therein. In one example, the collar 20 may itself be formed of a soft or elastomeric material that enhances a seal that can be formed by tightening a lid thereon.

Figure 5:
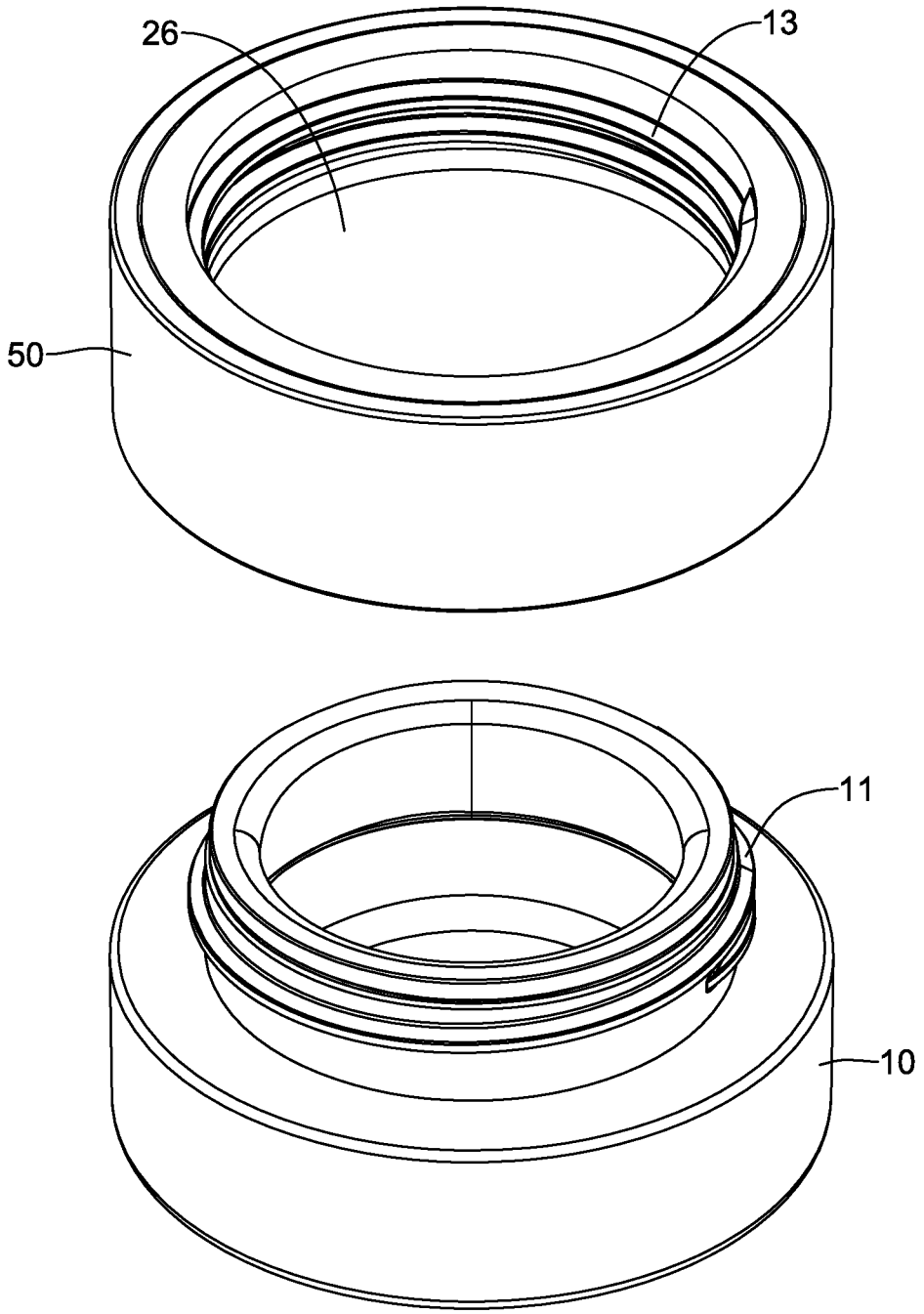
FIG. 5 is an illustrative view of the cap and cosmetic jar side by side.

FIG. 5 is an illustrative view of the screw cap 50 and cosmetic jar 10 side by side. The screw cap 50 maybe secured to the cosmetic jar container 10 by interaction of the external threads 11 on the neck of the cosmetic jar 10 with internal threads 13 on the screw cap 50. The screw cap 50 may include an external window 26 in the upper region of the screw cap 50 through which contents of the cosmetic jar 10 may be observed. The external window 26 made be made of any transparent or semi-transparent material such as plastic or glass. The screw cap 50 includes an internal threading 13 on the inner surface thereof. This example shows threading; tab and slot, snap fit, or hinged opening/closing may be provided as alternatives.

Figure 6A:
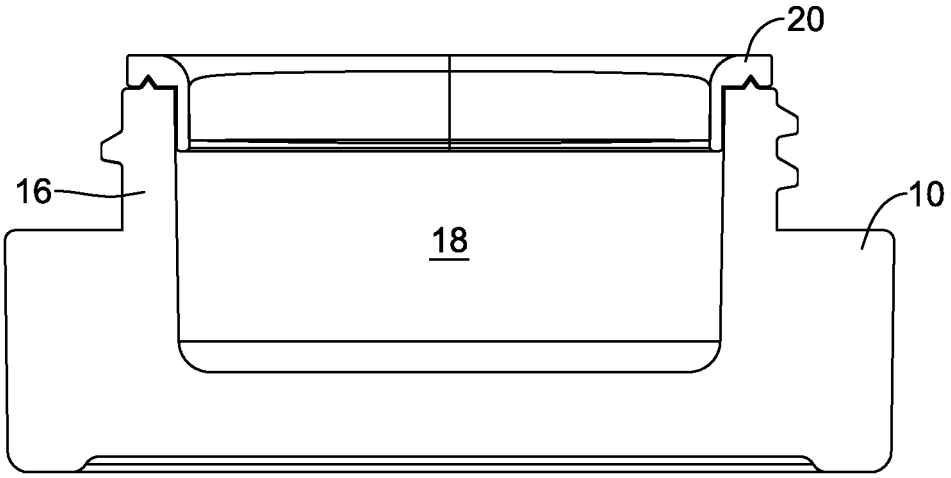
FIG. 6A is an illustrative cross-section view of the cosmetic jar and collar.
Figure 6B:
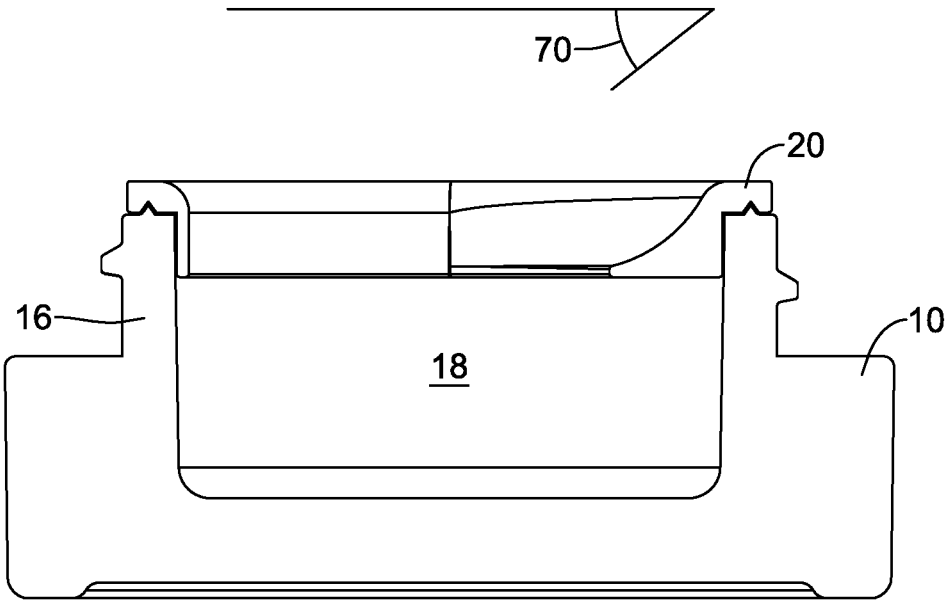
FIG. 6B is another illustrative cross-sectional view of the cosmetic jar and collar.

FIGS. 6A and 6B are cross-sectional views of the cosmetic jar container 10 and the collar 20. The manipulation surface 22 defines an angle relative to a plane on which the top of the neck 16 is defined as shown at 70. In some examples, angle 70 may be in the range of about 30 to about 65 degrees in some examples. In an embodiment, angle 70 is in the range of about 50 degrees.

Figure 7:
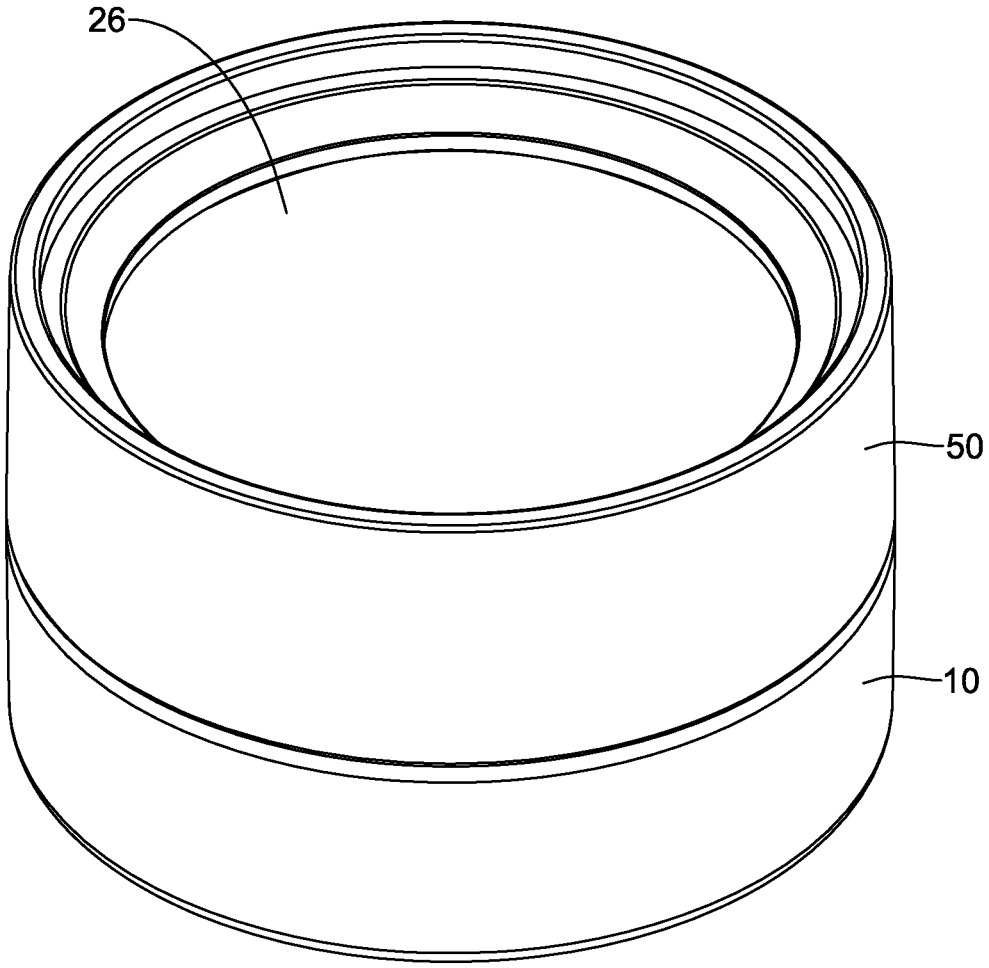
FIG. 7 is an illustrative view of the cosmetic jar container with the cap attached.

FIG. 7 is an illustrative view of the cosmetic jar container with the cap attached. The screw cap 50 may be removed by applying a twisting force in a second direction, opposite the first direction, between the cosmetic jar container 10 and the screw cap 50.

The cosmetic jar container 10, screw cap 50, collar 20, and manipulation surface 22 as shown and described above may be made of any suitable clear or colored material such as, for example, thermoplastic elastomer (TPE), low density polyethylene (LDPE), synthetic polymer, partially of a resin such as, for example, acrylonitrile butadiene styrene (ABS), styrene acrylonitrile (SAN), pentachlorothioanisole (PCTA), polypropylene (PP), polyethylene (PE), polyethylene terephthalate (PET, PETE, PETG), polyurethane, plastic, rubber, silicone, nylon, ceramic, glass, metal, or composite material, and/or combinations thereof. The term "plastic" to mean any synthetic resin suitable for the purpose such as polymethyl methacrylate (PMMA) or glass reinforced polypropylene (PPG) clear thick walled plastic. If glass, the glass jar may be double walled. Moreover, various elements may be made of any combination of substantially clear, substantially opaque, and/or translucent materials. Natural materials as wood, stone or leather may be used as well for decorative or other purposes.

Figure 8:
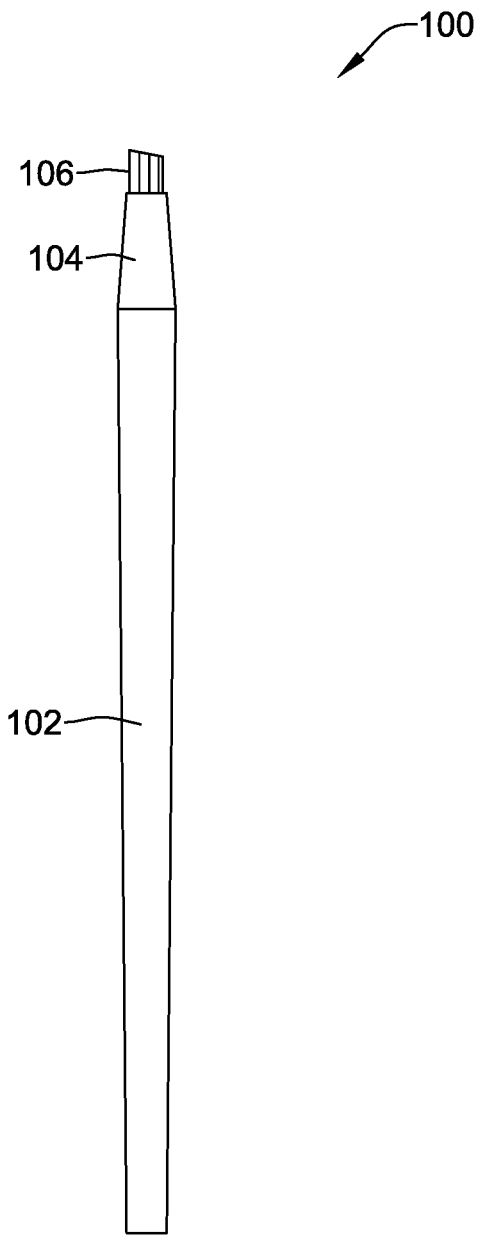
FIG. 8 shows an illustrative brush that may be used in some embodiments.

FIG. 8 shows an illustrative brush that may be used in some embodiments. The brush 100 includes a handle 102, ferrule 104, and bristles 106. The design shown may be typical of a brow brush, which can be used with loose powder products to be stored in a cosmetics jar including a collar as shown above. Other brushes and brush types may be used, as well as other applicators of various types. For example, a user may apply a cosmetic product by inserting brush 100 through a collar 20 as shown above into the reservoir of a cosmetic jar 10 to obtain a quantity of product on the bristles 106. The user can then withdraw the brush 100 and use the manipulation surface 22 of the collar 20 to remove excess product and/or distribute product on the bristles 106 of the brush 100 by scraping, rubbing, tapping or otherwise maneuvering the brush 100 with the bristles against the manipulation surface 22 of collar 20. The user then applies the product to an application surface, such as the eyebrows, and may repeat the process until a desired look or effect is had.

In the event of inconsistent usages between this document and any documents so incorporated by reference, the usage in this document controls. In this document, the terms "a" or "an" are used, as is common in patent documents, to include one or more than one, independent of any other instances or usages of "at least one" or "one or more" unless the content clearly dictates otherwise. Moreover, in the following claims, the terms "first," "second," and "third," etc. are used merely as labels, and are not intended to impose numerical requirements on their objects. The above description is intended to be illustrative, and not restrictive.

As used in the above description and the appended claims, the term "or" is generally employed in its sense including "and/or" unless the content clearly dictates otherwise.

Relative terms such as "front", "back", "side", "top", "bottom", variants thereof, and the like, may be generally be considered with respect to the positioning, direction, and/or operation of various elements relative to a user and/or other components of the device. It is to be understood that relative terms are not intended to be limiting and are only exemplary.

The above detailed description should be read with reference to the drawings in which similar elements in different drawings are numbered the same. The drawings, which are not necessarily to scale, show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein. For example, the above examples (or one or more aspects thereof) may be used in combination with each other. Other embodiments can be used, such as by one of ordinary skill in the art upon reviewing the above description.

The Abstract is provided to comply with 37 C.F.R. § 1.72(b), to allow the reader to quickly ascertain the nature of the technical disclosure. It is submitted with the understanding that it will not be used to interpret or limit the scope or meaning of the claims.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

What is claimed is:

1. A cosmetic container for storing a cosmetic product comprising:

a cosmetic jar having a main body defining a reservoir for containing the product and a neck on an upper portion thereof with an upper end having an opening for accessing product in the reservoir;

a collar fitted to the upper end of the neck, the collar having an upper rim defining a first opening therethrough at a top end of the collar, and a manipulation surface extending down into the reservoir from the collar upper rim along a portion of the first opening, the collar configured to allow a user to insert an applicator through the collar and into the reservoir to dispense the product, wherein the collar has a second opening at a bottom end thereof extending toward the reservoir, wherein an entirety of the manipulation surface is a single solid, continuous surface extending downward around a portion of a circumference of the collar between the first opening and the second opening of the collar, the manipulation surface extending continuously and circumferentially between a first end and a second end, the manipulation surface having a concave shape, wherein the collar upper rim extends around 360 degrees of the neck, wherein the manipulation surface extends around about 90 to about 270 degrees of the collar upper rim, wherein the continuous manipulation surface includes a plurality of ridges disposed on the single solid, continuous manipulation surface; and a cap configured to couple with the main body.

2. The cosmetic container as in claim 1, wherein the collar upper rim comprises an inner side wall that extends into the cosmetic jar, wherein the manipulation surface of the collar projects inward from the side wall.

3. The cosmetic container of claim 2, wherein an inner part of the cap comprises internal threading to mate with external threading of the cosmetic jar neck.

4. The cosmetic container as in claim 1, wherein the cap is a screw cap assembly comprising an inner lid having at least one horizontal protrusion and at least one vertical recess on its outer surface and an outer shell having at least one horizontal recess and at least one vertical protrusion on its inner surface, and the cap is assembled such that the horizontal protrusion and horizontal recess cooperate, and the vertical protrusion and vertical recess cooperate, to secure the inner lid and the outer shell together.

5. The cosmetic container as in claim 1, wherein the cap includes a transparent or semi-transparent window on a top surface thereof to view a loose powder product in the reservoir.

6. The cosmetic container as in claim 1, wherein the manipulation surface extends around about 180 degrees of the collar upper rim.

7. The cosmetic container as in claim 1, wherein the neck defines an opening having a diameter, wherein the manipulation surface extends inward from the neck over about 10% to about 25% of the diameter of the neck.

8. The cosmetic container as in claim 1, wherein the neck defines an opening having a diameter, wherein the manipulation surface extends inward from the neck over about 15% of the diameter of the neck.

9. A cosmetic container comprising:

a cosmetic jar having a body defining a reservoir and having a neck allowing access to product in the reservoir;

a cap configured for coupling to the cosmetic jar; and a collar on the neck of the cosmetic jar having an upper rim defining a first opening therethrough at a top end of the collar and a second opening at a bottom end of the collar extending toward the reservoir, and a manipulation surface extending down from the collar upper rim defining a curved inner edge at a bottom edge thereof such that on one portion of the collar, an inner sidewall extends straight down from the collar upper rim and on a second portion of the collar, the manipulation surface extends downward at an angle towards the reservoir, wherein an entirety of the manipulation surface is a single solid, continuous surface extending downward around a portion of a circumference of the collar between the first opening and the second opening of the collar, the manipulation surface extending continuously and circumferentially between a first end and a second end, the manipulation surface having a concave shape, wherein the collar upper rim extends around 360 degrees of the neck, wherein the manipulation surface extends around about 90 to about 270 degrees of the collar upper rim, wherein the continuous manipulation surface includes a plurality of ridges disposed on the single solid, continuous manipulation surface, the collar configured to allow a user to insert a brush through the collar and into the reservoir to dispense the product, and the manipulation surface allows a user to scrape, rub or tap the brush thereon.

10. The cosmetic container as in claim 9, wherein the neck defines an opening having a radius, wherein the manipulation surface extends inward from the neck over about 15% to about 50% of the radius.

11. The cosmetic container as in claim 9, wherein the neck defines an opening having a radius, wherein the manipulation surface extends inward from the neck over about 30% of the radius.

12. The cosmetic container as in claim 9, wherein the manipulation surface defines an angle, relative to a plane on which the top of the neck is defined, of about 30 to about 65 degrees.

13. The cosmetic container as in claim 9, wherein the manipulation surface defines an angle, relative to a plane on which the top of the neck is defined, of about 50 degrees.

14. The cosmetic container as in claim 9, wherein the inner shape of the collar is circular on one side and oval on the side of the manipulation surface.

15. The cosmetic container of claim 1, wherein the manipulation surface has a single second opening extending toward the reservoir.

* * * * *